US010162280B2

(12) United States Patent
Nishikawa et al.

(10) Patent No.: US 10,162,280 B2
(45) Date of Patent: Dec. 25, 2018

(54) TONER

(71) Applicant: CANON KABUSHIKI KAISHA, Tokyo (JP)

(72) Inventors: Kouji Nishikawa, Susono (JP); Katsuhisa Yamazaki, Numazu (JP); Daisuke Yoshiba, Suntou-gun (JP); Shotaro Nomura, Suntou-gun (JP); Hiroki Akiyama, Toride (JP); Masami Fujimoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/909,071

(22) PCT Filed: Jul. 25, 2014

(86) PCT No.: PCT/JP2014/070294

§ 371 (c)(1),
(2) Date: Jan. 29, 2016

(87) PCT Pub. No.: WO2015/016336

PCT Pub. Date: Feb. 5, 2015

(65) Prior Publication Data

US 2016/0179024 A1 Jun. 23, 2016

(30) Foreign Application Priority Data

Jul. 31, 2013 (JP) ..... 2013-159300

(51) Int. Cl.

| | |
|---|---|
| ***G03G 9/097*** | (2006.01) |
| ***G03G 9/08*** | (2006.01) |
| ***G03G 9/087*** | (2006.01) |

(52) U.S. Cl.

CPC ..... *G03G 9/0825* (2013.01); *G03G 9/0821* (2013.01); *G03G 9/08755* (2013.01); *G03G 9/08795* (2013.01); *G03G 9/08797* (2013.01); *G03G 9/09716* (2013.01)

(58) Field of Classification Search

CPC ..... G03G 9/09708; G03G 9/09725; G03G 9/09733

See application file for complete search history.

(56) References Cited

FOREIGN PATENT DOCUMENTS

| | | | | | |
|---|---|---|---|---|---|
| JP | 2002131976 | A | | 5/2002 | |
| JP | 3321675 | B2 | | 9/2002 | |
| JP | 2004212740 | A | | 7/2004 | |
| JP | 2005024784 | A | | 1/2005 | |
| JP | 4321272 | B2 | | 8/2009 | |
| JP | 2011-017913 | A | | 1/2011 | |
| JP | 2011090168 | A | | 5/2011 | |
| JP | 2012168222 | A | | 9/2012 | |
| JP | 2012189881 | A | | 10/2012 | |
| JP | 2013-083837 | | * | 5/2013 | ..... G03G 9/08 |
| JP | 2013083837 | A | | 5/2013 | |
| WO | 2013063291 | A1 | | 5/2013 | |
| WO | WO 2013/063291 | | * | 5/2013 | ..... G03G 9/097 |

OTHER PUBLICATIONS

Translation of JP 2013-083837.*

* cited by examiner

*Primary Examiner* — Peter L Vajda
(74) *Attorney, Agent, or Firm* — Canon U.S.A., Inc. IP Division

(57) ABSTRACT

A toner having excellent development performance, low-temperature fixation, and high-temperature storage stability is provided. An external additive contained in this toner is an organic-inorganic composite fine particle containing an inorganic fine particle embedded in a resin fine particle. The resin fine particle is made from a resin having a melting point of 60° C. or more and 150° C. or less.

6 Claims, No Drawings

TONER

TECHNICAL FIELD

The present invention relates to a toner used in image formation methods such as electronic photography.

BACKGROUND ART

There is a demand for electrophotographic image formation apparatus having an enhanced speed, extended longevity, and improved energy consumption. To meet this demand, toners should also be improved in various performance aspects. Extending the longevity, in particular, requires that a toner be able to develop an image even after long use. Enhancing the processing speed and energy consumption requires that the low-temperature fixation of a toner be enhanced.

As the market expands, electrophotographic image formation apparatus have been increasingly used in hot regions, such as Southeast Asia and the Near and Middle East. The storage stability of a toner at high temperatures that could be reached in such a region is becoming more and more important.

To meet these requirements, i.e., stable development for long periods of time, enhanced low-temperature fixation, and high-temperature storage stability, researchers have proposed various toners.

PTL 1 proposes stabilizing the chargeability of a toner by adding large-diameter silica as inorganic spacer particles.

PTL 2 proposes that adding crystalline resin particles to toner particles improves the low-temperature fixation of the toner. PTL 3 proposes that adding composite particles containing silica fine particle and particulate melamine to toner particles provides the toner with improved development performance, protection against image deletion, and the ease of cleaning.

PTL 4 proposes adding composite particles containing inorganic fine particles fixed on the surface of organic fine particles in order to make the toner less sensitive to its surrounding environment.

PTL 5 proposes an external additive for toners, and this external additive contains composite particles containing inorganic fine particles embedded in the surface of resin fine particles.

CITATION LIST

Patent Literature

PTL 1 Japanese Patent Laid-Open No. 2012-168222
PTL 2 Japanese Patent Laid-Open No. 2011-17913
PTL 3 Japanese Patent No. 4321272
PTL 4 Japanese Patent No. 3321675
PTL 5 WO 2013/063291

SUMMARY OF INVENTION

The inventors have conducted studies on the toners described in these publications.

The results were as follows: The toner according to PTL 1 should be further improved in terms of low-temperature fixation. The toner according to PTL 2 was found to be somewhat lacking in development performance and storage stability. The toners according PTL 3 and PTL 4 had an insufficient low-temperature fixation.

The external additive according to PTL 5 and a toner were also found to be insufficient in terms of the low-temperature fixation of the toner because the resin fine particles used in the external additive is made from a cross-linking resin.

The present invention therefore provides a toner having excellent development performance and high-temperature storage stability as well as excellent low-temperature fixation.

An aspect of the invention is a toner containing a toner particle and an external additive. The external additive is an organic-inorganic composite fine particle containing a resin fine particle and an inorganic fine particle which is embedded in the resin fine particle, and at least a part of which is exposed. The resin fine particle is made from a resin having a melting point of 60° C. or more and 150° C. or less.

Further features of the present invention will become apparent from the following description of exemplary embodiments.

DESCRIPTION OF EMBODIMENTS

As mentioned above, there is a demand for a toner having excellent development performance, low-temperature fixation, and storage stability that are better than those of known toners.

Reducing the viscosity of toner particles (the main component of a toner) to improve low-temperature fixation can affect development performance and high-temperature storage stability. In some cases, a large amount of a particulate inorganic material may be added to a toner so that the toner should maintain its development performance even in a high-speed electrophotographic image formation process. Such a toner has good development performance and storage stability, but may be lacking in low-temperature fixation. It has been difficult to obtain a toner having high levels of development performance, low-temperature fixation, and storage stability.

The inventors focused on the low-temperature fixation of a toner, or in particular the fact that in an electrophotographic apparatus that performs a high-speed electrophotographic image formation process, paper carrying unfixed toner can receive heat from a fixing device during thermal fixation only for a limited period of time. The inventors assumed that a key to improving low-temperature fixation would be to finish melting the toner and binding the toner particles each other and/or the toner and the paper together in this short heating period.

The inventors thus estimated that adding a material that melts at low temperatures to the surface of toner particles would improve low-temperature fixation by allowing the surface of the toner to melt and the toner itself and the toner and the paper to bind together even in a short heating period.

However, simply adding a low-melting material to toner particles may result in the low-melting material on the surface of the toner reducing chargeability and adhering to a developer bearing member used in a developing device and can thereby lead to impaired development performance. Adhesion of the low-melting material to a developer bearing member interferes with the potential of the developer bearing member to provide charge to the toner and thereby reduces development performance. Furthermore, a toner containing a low-melting material may be lacking in storage stability.

The inventors thus devised a way that would prevent an external additive containing a low-melting material from seriously affecting chargeability and contaminating a developer bearing member. The inventors have also found that this approach allows the toner to maintain its development performance by preventing chargeability from lowering and a developer bearing member from being contaminated without affecting low-temperature fixation and, furthermore, improves storage stability.

More specifically, the inventors found that the use of an external additive that is an organic-inorganic composite fine particle containing a resin fine particle, and an inorganic fine particle which is embedded in the resin fine particle, and at least a part of which is exposed, the resin fine particle made from a resin having a melting point of 60° C. or more and 150° C. or less, would ensure the development performance, low-temperature fixation, and storage stability of a toner all at high levels.

When an organic-inorganic composite fine particle containing an inorganic fine particle embedded in a resin fine particle made from a resin having a melting point in the temperature range of 60° C. to 150° C. is used as an external additive, the external additive melts in a very short period of time in response to heat from a fixing device. The external additive melting fast on the surface of the toner quickly binds the toner itself and the toner and paper together, thereby improving low-temperature fixation. Having a melting point in the range of 60° C. to 150° C. means that the substance has one or more endothermic peaks in the range of 60° C. to 150° C. when analyzed using DSC (differential scanning calorimetry).

If the resin fine particle used in the organic/inorganic composite fine particle were made from a resin having no melting point in this temperature range, it would be difficult to melt the resin fine particle with heat from a fixing device in a short period of time, and it would thus be difficult to obtain the effect of improving low-temperature fixation. In particular, the use of a resin fine particle made from a resin having a melting point of less than 60° C. would likely affect development performance and storage stability. The use of a resin fine particle made from a resin having a melting point of more than 150° C. would make it difficult to obtain the effect of improving low-temperature fixation.

Furthermore, the structure of an organic-inorganic composite fine particle according to an embodiment of the invention, in which an inorganic fine particle is embedded in a resin fine particle made from a resin having a melting point in a specified temperature range, makes it easier to enhance the chargeability of the organic-inorganic composite fine particle and thereby allows one to improve the development performance of a toner.

The use of such an organic-inorganic composite fine particle also reduces the adhesion of resin to the surface of a developer bearing member by decreasing the chance of direct contact of particulate resin with the developer bearing member and, as a result, prevents development performance from being affected.

Furthermore, the use of this organic-inorganic composite fine particle, making it easier to reduce the chance of direct contact of particulate resin with other toner particles, enhances high-temperature storage stability.

In relation to low-temperature fixation, the organic-inorganic composite fine particle is present on the outermost surface of the toner and thus can receive sufficient heat from a fixing device. The structure of the organic-inorganic composite fine particle, in which an inorganic fine particle is embedded in a resin fine particle, is unlikely to be an obstruction of the resin fine particle in melting to bind the toner itself and bind the toner and paper together.

The following describes an organic-inorganic composite fine particle according to an embodiment of the invention.

An organic-inorganic composite fine particle according to an embodiment of the invention contains an inorganic fine particle embedded in the surface of a resin fine particle, and the resin fine particle is made from a resin having a melting point of 60° C. or more and 150° C. or less. The inorganic fine particle may be dispersed in the resin fine particle as long as such a structure is maintained.

Adding a resin fine particle and an inorganic fine particle simultaneously or adding them sequentially may also provide an organic-inorganic composite fine particle that is apparently one entity as a result of interactions of the resin fine particle and the inorganic one on toner particles such as aggregation. With this method, however, it is unlikely that the advantages intended of certain aspects of the invention are obtained because of insufficient uniformity of the resin fine particle and the inorganic fine particle or incomplete embedding of the inorganic fine particle in the resin fine particle.

Examples of inorganic fine particles used in an organic-inorganic composite fine particle according to an embodiment of the invention include silica fine particle, alumina fine particle, titania fine particle, zinc oxide fine particle, strontium titanate fine particle, cerium oxide fine particle, and calcium carbonate fine particle. It is also possible to use a combination of any two or more selected from this group of particulate substances.

In particular, a toner according to an embodiment of the invention is remarkably chargeable when the inorganic fine particle contained in the organic-inorganic composite fine particle is silica fine particle. Silica fine particle substances obtained through a dry process, such as fumed silica, and those obtained through a wet process, such as the sol-gel method, can both be used.

The number-average particle diameter of the inorganic fine particle can be 5 nm or more and 100 nm or less. Making the number-average particle diameter of the inorganic fine particle 5 nm or more and 100 nm or less helps the inorganic fine particle to cover the surface of the resin fine particle, which is effective in preventing a developer bearing member from being contaminated and ensuring high-temperature storage stability.

An organic-inorganic composite fine particle according to an embodiment of the invention can be obtained using any known method.

An example of a method is to create an organic-inorganic composite fine particle by driving an inorganic fine particle into a resin fine particle. In this method, the resin fine particle is first prepared. The resin fine particle can be prepared through, for example, pulverizing frozen resin or phase-inversion emulsification of a resin dissolved in a solvent. Various machines can be used to drive an inorganic fine particle into the obtained particulate resin, including a hybridizer (Nara Machinery), Nobilta (Hosokawa Micron), Mechanofusion (Hosokawa Micron), and High Flex Gral (Earthtechnica). Processing a resin fine particle and an inorganic fine particle using such equipment, through which the inorganic fine particle is driven into the resin fine particle, provides the organic-inorganic composite fine particle.

It is also possible to create an organic-inorganic composite fine particle by producing a resin fine particle through emulsification polymerization in the presence of an inorganic fine particle. Dissolving a resin in an organic solvent and then performing phase-inversion emulsification of the resin with an inorganic fine particle in the solution also provides an organic-inorganic composite fine particle containing an inorganic fine particle embedded in a resin fine particle.

Examples of organic solvents that can be used to dissolve a resin include tetrahydrofuran (THF), toluene, methyl ethyl ketone, and hexane.

The resin fine particle used in an organic-inorganic composite fine particle according to an embodiment of the invention can be made from any kind of resin as long as the resin has a melting point in the range of 60° C. to 150° C. However, low-temperature fixation can be enhanced when the resin fine particle contains crystalline polyester.

When crystalline polyester is contained in the resin fine particle, examples of aliphatic diols that can be used to synthesize the crystalline polyester include the following: 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. These can be used alone or in mixture. Aliphatic diols that can be used in an embodiment of the invention are not limited to these.

Aliphatic diols having a double bond can also be used. Examples of aliphatic diols having a double bond include the following: 2-butene-1,4-diol, 3-hexene-1,6-diol, and 4-octene-1,8-diol.

The following describes acid components that can be used to synthesize crystalline polyester.

Examples of acid components that can be used to synthesize crystalline polyester include polybasic carboxylic acids.

Examples of aliphatic dibasic carboxylic acids include the following: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; lower alkyl esters and anhydrides of these acids; in particular, sebacic acid, adipic acid, 1,10-decanedicarboxylic acid, and lower alkyl esters and anhydride of these acids. These can be used alone or in mixture. Aliphatic dibasic carboxylic acids that can be used are not limited to these.

Examples of aromatic dicarboxylic acids include the following: terephthalic acid, isophthalic acid, 2,6-naphthalenedicarboxylic acid, and 4,4'-biphenyldicarboxylic acid. Terephthalic acid is easily available and is a monomer from which a low-melting polymer can be easily produced.

Dicarboxylic acids having a double bond can also be used. Examples of dicarboxylic acids of this type include fumaric acid, maleic acid, 3-hexenedioic acid, and 3-octenedioic acid. Lower alkyl esters and anhydrides of these acids can also be used. Fumaric acid and maleic acid are not very costly.

Crystalline polyester can be produced using any ordinary polyester polymerization process in which an acid component and an alcohol component are allowed to react. For example, crystalline polyester can be produced using direct polycondensation or transesterification, whichever is more appropriate for the monomers chosen.

The production of a crystalline polyester can be done at a polymerization temperature of 180° C. or more and 230° C. or less. The reaction may be conducted with the reaction system under reduced pressure so that the water and alcohol generated during condensation should be removed.

If a monomer is not dissolved in the solvent at the reaction temperature or if monomers are not compatible with each other, a high-boiling solvent may be added as a dissolution aid. If the reaction is polycondensation, the dissolution-aid solvent is distilled away during the reaction. If the reaction is a copolymerization that involves monomers incompatible with each other, these monomers may be condensed with the intended acid or alcohol before polycondensation with the main ingredient.

Examples of catalysts that can be used to produce crystalline polyester include titanium catalysts and tin catalysts.

Examples of titanium catalysts include titanium tetraethoxide, titanium tetrapropoxide, titanium tetraisopropoxide, and titanium tetrabutoxide. Examples of tin catalysts include dibutyl tin dichloride, dibutyl tin oxide, and diphenyl tin oxide.

In the resin fine particle used in an organic-inorganic composite fine particle according to an embodiment of the invention, the content of the resin having a melting point of 60° C. or more and 150° C. or less can be 50% by mass or more with respect to the resin fine particle. This allows the external additive to melt immediately in response to heat received from a fixing device, thereby enhancing the low-temperature fixation of the toner.

An organic-inorganic composite fine particle may be surface-treated with an organic silicon compound or silicone oil. Treatment with an organic silicon compound or silicone oil improves the hydrophobicity of the external additive, thereby providing the toner with development performance that is stable even under high-temperature and high-humidity conditions.

Examples of methods that can be used to produce an external additive surface-treated with an organic silicon compound or silicone oil include treating the surface of the organic-inorganic composite fine particle and treating the surface of the inorganic fine particle with an organic silicon compound or silicone oil prior to combining the inorganic fine particle with the resin.

The organic-inorganic composite fine particle or the inorganic fine particle used in the organic-inorganic composite fine particle may be made hydrophobic through chemical treatment with an organic silicon compound that reacts with or physically adsorbs onto the organic-inorganic composite fine particle or the inorganic fine particle.

An exemplary method is to produce silica fine particle through vapor-phase oxidation of a silicon halide and then treat the obtained silica fine particle with an organic silicon compound. Examples of organic silicon compounds include the following: hexamethyldisilazane, methyltrimethoxysilane, octyltrimethoxysilane, isobutyltrimethoxysilane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptans, trimethylsilyl mercaptan, triorganosilyl acrylates, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxanes having 2 to 12 siloxane units per molecule and one Si-bonded hydroxy group at the terminal units. These can be used alone, and it is also possible to use a mixture of two or more.

The organic-inorganic composite fine particle or the inorganic fine particle used in the particulate organic-inorganic material may be treated with silicone oil, with or without the hydrophobization described above.

Silicone oils that can be used include those having a viscosity of 30 $mm^2/s$ or more and 1000 $mm^2/s$ or less at 25° C. Specific examples of such silicone oils include dimethyl silicone oil, methyl phenyl silicone oil, α-methylstyrene-modified silicone oil, chlorophenyl silicone oil, and fluorinated silicone oil.

Examples of methods of treatment with silicone oil include the following: mixing silica fine particle treated with a silane coupling agent and the silicone oil directly in a mixing machine such as a Henschel mixer; spraying base silica fine particle with the silicone oil. Another possible method is to dissolve or disperse the silicone oil in an appropriate solvent, mix the obtained solution or dispersion with silica fine particle, and then remove the solvent.

The number-average particle diameter of an organic-inorganic composite fine particle according to an embodiment of the invention can be 30 nm or more and 500 nm or less. Making the number-average particle diameter in this range helps the external additive to melt in response to heat from a fixing device and thereby allows the toner itself and the toner and paper to firmly bind together, thereby improving low-temperature fixation, and also helps development performance to be maintained.

The inorganic fine particle content of an organic-inorganic composite fine particle according to an embodiment of the invention can be 10% by mass or more and 80% by mass or less based on the mass of the organic-inorganic composite fine particle. This enhances development performance, protection of a developer bearing member from contamination, and storage stability.

A toner according to an embodiment of the invention may contain any additive other than the organic-inorganic composite fine particle. In particular, adding a fluidity modifier can improve the fluidity and chargeability of the toner.

Examples of fluidity modifiers that can be used include the following:

Polymer resin fine powders such as vinylidene fluoride fine powders and polytetrafluoroethylene fine powders; silica fine powders such as wet-process silica and dry-process silica, titanium oxide fine powders, alumina fine powders, and treated compound thereof with a silane compound, a titanium coupling agent, or silicone oil; oxides such as zinc oxide and tin oxide; double oxides such as strontium titanate, barium titanate, calcium titanate, strontium zirconate, and calcium zirconate; carbonate compounds such as calcium carbonate and magnesium carbonate.

Such a fluidity modifier can be a silicon halide fine powder produced through vapor-phase oxidation, in particular, what is called dry-process silica or fumed silica. An example is a material obtained using thermal decomposition and oxidation of gaseous silicon tetrachloride in an oxyhydrogen flame. The basic reaction formula is as follows.

$$SiCl_4+2H_2+O_2 \rightarrow SiO_2+4HCl$$

In this production process, it is also possible to use the silicon halide with another metal halide, such as aluminum chloride or titanium chloride, to obtain a composite fine powder containing silica and another metal oxide. Silica includes composite fine powders of this type.

The average primary particle diameter of the fluidity modifier as determined using the number-based particle size distribution can be 5 nm or more and 30 nm. This ensures high chargeability and fluidity.

A treated silica fine powder obtained through the aforementioned gas-phase oxidation of a silicon halide and subsequent hydrophobization of the resulting silica fine powder can also be used as a fluidity modifier in an embodiment of the invention. Examples of methods of hydrophobization are similar to those described above for the surface treatment of the organic-inorganic composite fine particle or the inorganic fine particle used in the organic-inorganic composite fine particle.

A fluidity modifier can have a specific surface area of 30 $m^2/g$ or more and 300 $m^2/g$ or less based on the adsorption of nitrogen as measured using the BET method. The total amount of fluidity modifiers can be 0.01 parts by mass or more and 3 parts by mass or less per 100 parts by mass of the toner.

A toner according to an embodiment of the invention may be used as a one-component developer in mixture with a fluidity modifier and optionally with another external additive (e.g., a charge-controlling agent) and may also be used as a two-component developer in combination with a carrier.

When the toner is used in two-component development, all known carriers can be used with it. Specific examples of carriers that can be used include surface-oxidized and non-oxidized forms of metals such as iron, nickel, cobalt, manganese, chromium, and rare earth metals, alloys of these metals, and oxides of these metals.

Materials obtained through attaching a styrene resin, an acrylic resin, a silicone resin, a fluorocarbon polymer, or a polyester resin to the surface of particles of these carriers or coating particles of these carriers with any of these resins can also be used.

The following describes a toner particle according to an embodiment of the invention.

A binder resin used in a toner particle according to an embodiment of the invention is first described.

Examples of binder resins include polyester resins, vinyl resins, epoxy resins, and polyurethane resins. In particular, polyester resins, which generally have high polarity, improve development performance by allowing a polar charge-controlling agent to be uniformly dispersed.

A binder resin can have a glass transition temperature of 45° C. or more and 70° C. or less. The use of such a binder resin enhances storage stability.

A toner according to an embodiment of the invention may contain a magnetic particulate iron oxide so that the toner can be used as a magnetic toner. In this case, the magnetic particulate iron oxide may also serve as a colorant.

Examples of magnetic particulate iron oxides that can be contained in a magnetic toner in certain embodiments of the invention include iron oxides such as magnetite, hematite, and ferrite, metals such as iron, cobalt, and nickel, alloys of these metals and other metals such as aluminum, cobalt, copper, lead, magnesium, tin, zinc, antimony, bismuth, calcium, manganese, titanium, tungsten, and vanadium, and mixtures thereof.

The average particle diameter of a magnetic particulate iron oxide can be 2 μm or less, preferably 0.05 μm or more and 0.5 μm or less. The magnetic particulate iron oxide content of the toner can be 20 parts by mass or more and 200 parts by mass or less, preferably 40 parts or more and 150 parts by mass or less, per 100 parts by mass of the resin component.

Examples of colorants that can be used in certain embodiments of the invention are as follows.

Examples of black colorants that can be used include carbon black, grafted carbon, black-toned colorants prepared using the yellow, magenta, and cyan colorants listed below. Examples of yellow colorants include compounds represented by condensed azo compounds, isoindolinone compounds, anthraquinone compounds, azo metal complexes, methine compounds, and allyl amide compounds. Examples of magenta colorants include condensed azo compounds, diketopyrrolopyrrole compounds, anthraquinone, quinacridone compounds, basic dye lake compounds, naphthol compounds, benzimidazolone compounds, thioindigo compounds, and perylene compounds. Examples of cyan colorants include copper phthalocyanine compounds and their derivatives, anthraquinone compounds, and basic dye lake compounds. These colorants can be used alone, in mixture, or in the form of solid solution.

In an embodiment of the invention, a colorant is chosen on the basis of its hue angle, chroma, lightness, weather resistance, transparency on OHP film, and dispersibility in the toner. The colorant content can be 1 part by mass or more and 20 parts by mass or less per 100 parts by mass of the resin.

A toner according to an embodiment of the invention may further contain wax. Specific examples of waxes include the following:

- Aliphatic hydrocarbon waxes such as low-molecular-weight polyethylene, low-molecular-weight polypropylene, polyolefin copolymers, polyolefin wax, microcrystalline wax, paraffin wax, and Fischer-Tropsch wax;
- Oxides of aliphatic hydrocarbon waxes such as polyethylene oxide wax;
- Block copolymers of the aliphatic hydrocarbon waxes and oxides thereof;
- Vegetable waxes such as candelilla wax, carnauba wax, Japan wax, and jojoba wax;
- Animal waxes such as beeswax, lanoline, and spermaceti;
- Mineral waxes such as ozokerite, ceresin, and petrolatum;
- Waxes based on an aliphatic ester such as montanate wax and castor wax;
- Partially or fully refined aliphatic esters such as refined carnauba wax.

Other examples include the following: saturated linear fatty acids such as palmitic acid, stearic acid, montanic acid, and longer-chain alkyl carboxylic acids; unsaturated fatty acids such as brassidic acid, eleostearic acid, and parinaric acid; saturated alcohols such as stearyl alcohol, behenyl alcohol, carnaubyl alcohol, ceryl alcohol, mellisyl alcohol, and longer-chain alkyl alcohols; polyols such as sorbitol; aliphatic amides such as linoleic acid amide, oleic acid amide, and lauric acid amide; saturated aliphatic bisamides such as methylene bis-stearamide, ethylene bis-capramide, ethylene bis-lauramide, and hexamethylene bis-stearamide; unsaturated fatty acid amides such as ethylene bis-oleamide, hexamethylene bis-oleamide, N,N'-dioleyl adipamide, and N,N'-dioleyl sebacamide; aromatic bisamides such as m-xylene bisstearamide and N,N'-distearyl isophthalamide; aliphatic metal salts (commonly referred to as metal soaps) such as calcium stearate, calcium laurate, zinc stearate, and magnesium stearate; aliphatic hydrocarbon waxes grafted with the use of a vinyl monomer, such as styrene or acrylic acid; compounds obtained through partial esterification of a fatty acid and a polyol such as behenic acid monoglyceride; and hydroxy-containing methyl ester compounds obtained through hydrogenation of vegetable oils.

These waxes may be treated using pressure sweating, solvent extraction, recrystallization, vacuum evaporation, supercritical gas extraction, or melt crystallization to have a sharper molecular-weight distribution before use. Purified waxes from which impurities, such as low-molecular-weight solid fatty acids, low-molecular-weight solid alcohols, and other low-molecular-weight solid compounds, have been removed can also be used.

Specific examples of waxes that can be used as release agents include VISCOL® 330-P, 550-P, 660-P, and TS-200 (Sanyo Chemical Industries), Hi-WAX 400P, 200P, 100P, 410P, 420P, 320P, 220P, 210P, and 110P (Mitsui Chemicals), Sasol H1, H2, C80, C105, and C77 (Schumann Sasol), HNP-1, HNP-3, HNP-9, HNP-10, HNP-11, and HNP-12 (Nippon Seiro), Unilin® 350, 425, 550, and 700, Unicid®, Unicid® 350, 425, 550, and 700 (Toyo Petrolite), and Japan wax, beeswax, rice wax, candelilla wax, and carnauba wax (available from Cerarica NODA).

A toner according to an embodiment of the invention may contain a charge-controlling agent for stabilizing the chargeability of the toner. Such a charge-controlling agent can be an organic metal complex or a chelate compound, which both contain a central metal atom that easily interacts with the terminal acid or hydroxy group of a binder resin used in an embodiment of the invention. Examples include the following: monoazo metal complexes; acetylacetone metal complexes; and complexes or salts of aromatic hydroxycarboxylic acids or aromatic dicarboxylic acids with metals.

Specific examples of charge-controlling agents that can be used include Spilon Black TRH, T-77, and T-95 (Hodogaya Chemical) and BONTRON® S-34, S-44, S-54, E-84, E-88, and E-89 (Orient Chemical Industries). It is also possible to use a charge-controlling resin in combination with a charge-controlling agent.

A toner particle according to an embodiment of the invention can be produced using any appropriate method. Examples of methods that can be used include pulverization and what are referred to as polymerization processes, such as emulsification polymerization, suspension polymerization, and dissolution suspension.

In a pulverization process, the first step is to thoroughly mix the materials that make up the toner particle, such as a binder resin, a colorant, wax, and a charge-controlling agent, using a Henschel mixer, a ball mill, or any other mixing machine. Then the obtained mixture is melt-kneaded using a thermal kneading machine, such as a twin-screw kneading and extruding machine, heating rollers, a kneader, and an extruder, and the kneaded material is allowed to cool until it solidifies, followed by pulverization and classification. This provides a toner particle according to an embodiment of the invention.

Any desired external additive may be thoroughly mixed using a Henschel mixer or any other mixing machine.

Examples of mixing machines include the following: Henschel mixers (Mitsui Mining); SUPERMIXER (Kawata Mfg.); RIBOCONE (Okawara Mfg.); Nauta Mixer, Turbulizer, and Cyclomix (Hosokawa Micron); spiral-pin mixers (Pacific Machinery & Engineering); and Lodige mixers (MATSUBO Corporation).

Examples of kneading machines include the following: KRC kneaders (Kurimoto, Ltd.); Buss co-kneaders (Buss); TEM extruders (Toshiba Machine); TEX twin-screw kneaders (The Japan Steel Works); PCM kneaders (Ikegai Ironwork); triple-roll mills, mixing roll mills, and kneaders (Inoue Mfg.); Kneadex (Mitsui Mining); MS dispersion mixers and Kneader-Ruder (Moriyama Co., Ltd.); and Banbury mixers (Kobe Steel).

Examples of grinding machines include the following: Counter Jet Mill, Micron Jet, and Inomizer (Hosokawa Micron); IDS mills and PJM Jet Mill (Nippon Pneumatic Mfg.); Cross Jet Mill (Kurimoto, Ltd.); ULMAX (Nisso Engineering); SK Jet-O-Mill (Seishin Enterprise); KRYP- TRON (Kawasaki Heavy Industries); Turbo Mills (Turbo Kogyo); and Super Roter (Nisshin Engineering).

Examples of classifying machines include the following: Classiel, Micron Classifier, and Spedic Classifier (Seishin Enterprise); Turbo Classifier (Nisshin Engineering); Micron Separator, Turboplex (ATP), and TSP separator (Hosokawa Micron); Elbow-Jet (Nittetsu Mining); Dispersion Separators (Nippon Pneumatic Mfg.); and YM Micro Cut (Yaskawa Co., Ltd.).

The following describes the measurement of characteristics of a toner according to an embodiment of the invention.

Measurement of the Weight-Average Particle Diameter (D4) of a Toner Particle

The weight-average particle diameter (D4) of a toner is determined as follows. "Coulter Counter Multisizer 3®" (Beckman Coulter), an accurate particle sizing and counting analyzer based on the electrical sensing zone method, is used with a 100-μm aperture tube as measuring instrument. The accompanying dedicated software "Beckman Coulter Multisizer 3 Version 3.51" (Beckman Coulter) is used to set measurement parameters and analyze measurement data. The number of effective measurement channels during measurement is 25000.

The aqueous electrolytic solution for the measurement can be an about 1% by mass solution of special-grade sodium chloride in ion-exchanged water, e.g., "ISOTON II" (Beckman Coulter).

Prior to the measurement and analysis, the settings of the dedicated software were arranged as follows.

On the dedicated software, the parameters displayed in the "Edit the SOM (Standard Operating Method)" window are arranged as follows: Total Count under Control Mode, 50000 particles; Number of Runs, 1; Kd, the value obtained using "10.0-μm standard particles" (Beckman Coulter). Clicking the "Measure Noise Level" button automatically determines the threshold and the noise level. The current is 1600 μA, the gain is 2, and the electrolyte is ISOTON II. "Flush Aperture Tube" is checked.

In the "Convert Pulses to Size Settings" window of the dedicated software, the bin spacing is Log Diameter, the number of size bins is 256 Size Bins, and the size range is from 2 μm to 60 μm.

The following is a detailed description of a measurement procedure.

(1) A 250-mL glass round-bottom beaker dedicated for Multisizer 3 with approximately 200 mL of the aqueous electrolytic solution is placed in the sample stand and stirred counterclockwise at 24 rps using a stirrer rod. The "Flush Aperture Tube" function of the dedicated software is used to remove stains and air bubbles from the aperture tube.

(2) Approximately 30 mL of the aqueous electrolytic solution is put into a 100-mL glass round-bottom beaker. Approximately 0.3 mL of a diluted solution of "Contaminon N" (trade name; a 10% by mass aqueous solution of a neutral detergent for cleaning precision measuring instruments with a pH of 7 composed of a nonionic surfactant, a cationic surfactant, and an organic builder, available from Wako Pure Chemical Industries) diluted in ion-exchanged water by a factor of approximately 3 by mass is then added.

(3) "Ultrasonic Dispersion System Tetra 150" (trade name; Nikkaki Bios), an ultrasonic dispersion machine offering an electric output of 120 W and containing two oscillators with an oscillation frequency of 50 kHz placed with a phase difference of 180°, is prepared. Approximately 3.3 L of ion-exchanged water is poured into the water tank of the ultrasonic dispersion machine, and approximately 2 mL of Contaminon N is added to the water tank.

(4) The ultrasonic dispersion machine is turned on with the beaker of (2) placed in the beaker-holding hole of the ultrasonic dispersion machine. The vertical position of the beaker is adjusted so that the resonance on the surface of the aqueous electrolytic solution in the beaker should be maximized.

(5) Approximately 10 mg of the toner is added in small amounts to the aqueous electrolyte solution in the beaker of (4) and dispersed in the electrolyte solution while the solution is sonicated. The sonication is continued for another 60 seconds. The conditions of the ultrasonic dispersion may be arranged so that the temperature of the water in the water tank should be 10° C. or more and 40° C. or less.

(6) The aqueous electrolytic solution of (5), which contains the toner dispersed therein, is added dropwise to the round-bottom beaker of (1) in the sample stand using a pipette. The volume of the solution added is adjusted so that the concentration at measurement should be approximately 5%. Measurement is performed until the number of particle counts reaches 50000.

(7) The weight-average particle diameter (D4) is determined through analyzing the measurement data on the dedicated software supplied with the equipment. The "Mean Diameter" in the "Analysis-Volume Statistics (Arithmetic Mean)" window indicated when Graph-% by Volume is chosen on the dedicated software corresponds to the weight-average particle diameter (D4).

Measurement of the Degree of Aggregation of a Toner

The degree of aggregation of a toner was measured as follows.

"Powder Tester" (trade name; Hosokawa Micron) was used as measuring instrument with the side of its vibration stage connected with "DIGIVIBRO MODEL 1332A" digital display vibrometer (trade name; Showa Sokki). On the vibration stage of the Powder Tester, a sieve having 38-μm pores (400 mesh), a sieve having 75-μm pores (200 mesh), and a sieve having 150-μm pores (100 mesh) were placed in this order. The measurement was performed under 23° C. and 60% RH conditions through the following procedure.

(1) Prior to the measurement, the vibration width of the vibration stage was adjusted so that the displacement indicated by the digital display vibromater should be 0.60 mm (peak-to-peak).

(2) Five grams of the toner, left under 23° C. and 60% RH conditions for 24 hours beforehand, was precisely weighed and gently placed on the uppermost 150-μm-pore sieve.

(3) After 15 seconds of vibration of the sieves, the mass of the toner left on each sieve was measured. Then the degree of aggregation was calculated using the following equation:

$$\text{Aggregation}(\%)=\{(\text{Mass of the sample on the 150-}\mu\text{m-pore sieve(g)})\text{-}5\ (\text{g})\}\times100+\{(\text{Mass of the sample on the 75-}\mu\text{m-pore sieve (g)})/5(\text{g})\}\times100\times0.6+\{(\text{Mass of the sample on the 38-}\mu\text{m-pore sieve(g)})/5(\text{g})\}\times100\times0.2$$

Measurement of the Number-Average Particle Diameter of an Organic-Inorganic Composite Fine Particle The number-average particle diameter of an organic-inorganic composite fine particle is measured using a scanning electron microscope "S-4800" (trade name; Hitachi). A toner containing the organic-inorganic composite fine particle is observed in magnified views up to ×200000, and the longitudinal diameter of 100 randomly chosen primary particles of the organic-inorganic composite fine particle is measured and used to determine the number-average particle diameter. The magnification may be adjusted according to the size of the organic-inorganic composite fine particle.

Measurement of the Melting Point and Glass Transition Temperature Tg of the Resin Used in the Organic-Inorganic Composite Fine Particle The melting point and glass transition temperature Tg of the resin used in the organic-inorganic composite fine particle is measured in accordance with ASTM D3418-82 using a differential scanning calorimeter "Q1000" (trade name; TA Instruments). The detector of the calorimeter is calibrated for temperature using the melting point of indium and zinc and for calorific volume using the heat of fusion of indium.

A more detailed description is as follows. Approximately 0.5 mg of a sample is precisely weighed and placed in an aluminum pan. A reference measurement is performed using an empty aluminum pan in the temperature range of 20° C. to 220° C. where the temperature is elevated at a rate of 10° C./min. During the measurement, the temperature is first elevated to 220° C., decreased to 30° C. at a rate of 10° C./min, and then elevated at a rate of 10° C./min once again. The DSC curve obtained during the second heating process is used to determine the characteristics specified in certain aspects of the invention.

In this DSC curve, the temperature at which the DSC curve has the maximum endothermic peak within the temperature range of 20° C. to 220° C. is defined as the melting point of the organic-inorganic composite fine particle.

In this DSC curve, the point where the DSC curve crosses a line that is intermediate between the baselines before and after the change in specific heat is defined as the glass transition temperature Tg.

For example, when the melting point and glass transition temperature Tg of the resin used in the organic-inorganic composite fine particle of a toner containing the external additive are measured, the organic-inorganic composite fine particle may be isolated from the toner. After removal of the external additive through ultrasonic dispersion of the toner in ion-exchanged water, the toner is allowed to stand for 24 hours. Collecting and drying the supernatant yields the isolated external additive. When the toner contains multiple additives, the supernatant may be centrifuged so that the external additive of interest can be isolated for measurement.

Measurement of the Melting Point of the Resin Fine Particle

The melting point of the resin fine particle was determined in a way similar to the method of the measurement of the melting point of the resin used in the organic-inorganic composite fine particle.

EXAMPLES

The following describes certain aspects of the invention in more detail by providing examples and comparative examples. No aspect of the invention is limited to these examples.

As crystalline resins, Crystalline resin 1 and Crystalline resin 2 detailed in Table 1 were prepared.

TABLE 1

| | Composition | Endothermic peak (° C.) |
|---|---|---|
| Crystalline resin 1 | Polyester resin | 85 |
| Crystalline resin 2 | Polyester resin | 115 |

Production Example of Organic-Inorganic Composite Fine Particle 1

Ten grams of Crystalline resin 1 and 40 g of toluene were put into a reaction vessel provided with a stirrer, a condenser, a thermometer, and a nitrogen introduction tube. The reaction vessel was heated to 60° C. and the resin was dissolved.

Then 0.8 g of dialkyl sulfosuccinate (trade name, SANMORIN OT-70; Sanyo Chemical Industries), 0.17 g of dimethylaminoethanol, and 20 g of organo-silica sol (trade name, Organosilicasol MEK-ST-40; Nissan Chemical Industries; number-average particle diameter, 15 nm; percent solid weight, 40%) as an inorganic fine particle were added while the solution was stirred. Then 60 g of water was added at a rate of 2 g/min while the mixture was stirred so that phase-inversion emulsification should occur. Then evaporating toluene at a temperature setting of 40° C. while bubbling the emulsion with nitrogen at 100 mL/min yielded a liquid dispersion of Organic-inorganic composite fine particle 1. The solid concentration of the dispersion was adjusted to 30%.

DSC measurement of a dried dispersion of Organic-inorganic composite fine particle 1 found an endothermic peak at 87° C.

Organic-inorganic composite fine particle 1 has a resin fine particle and an inorganic fine particle which is embedded in the resin fine particle, and a part of which is exposed.

Production Example of Organic-Inorganic Composite Fine Particle 2

In the production example of Organic-inorganic composite fine particle 1, the resin was changed to Crystalline resin 2, and the quantity of dimethylaminoethanol was changed to 0.56 g. Except for these, a liquid dispersion of Organic-inorganic composite fine particle 2 was obtained in the same way as in the production example of Organic-inorganic composite fine particle 1. The solid concentration of the dispersion was adjusted to 30%. DSC measurement of a dried dispersion of Organic-inorganic composite fine particle 2 found an endothermic peak at 116° C.

Organic-inorganic composite fine particle 2 has a resin fine particle and an inorganic fine particle which is embedded in the resin fine particle, and a part of which is exposed.

Production Example of Organic-Inorganic Composite Fine Particle 3

To a reaction vessel provided with a stirrer, a condenser, a thermometer, and a nitrogen introduction tube 860 g of water and 196 g of organo-silica sol (trade name, Organosilicasol MEK-ST-40; Nissan Chemical Industries; number-average particle diameter, 15 nm; percent solid weight, 40%) as a particulate inorganic material were added. Heating the mixture to 60° C. with 20 g of butyl acrylate and 78 g of styrene while stirring yielded a solution of emulsion particles. Then 5 g of a 50% by mass solution of 2,2'-azobis (2,4-dimethylvaleronitrile) in toluene as a polymerization initiator was added to this solution of emulsion particles, and the obtained solution was maintained at 60° C. for 4 hours so that polymerization reaction should proceed. Filtering this solution and drying the residue yielded Organic-inorganic composite fine particle 3. DSC measurement of Organic-inorganic composite fine particle 3 found no endothermic peak but identified a Tg at 88° C.

Organic-inorganic composite fine particle 3 has a resin fine particle and an inorganic fine particle which is embedded in the resin fine particle, and a part of which is exposed.

Production Example of Resin Fine Particle 1

A liquid dispersion of Resin fine particle 1 was obtained in the same way as in the production example of Organic-inorganic composite fine particle 1 except that no organosilica sol was used in the production example of Organic-inorganic composite fine particle 1. The solid concentration of the dispersion was adjusted to 30%. DSC measurement of a dried dispersion of Resin fine particle 1 found an endothermic peak at 86° C.

Production Example of Toner Particle 1

Amorphous polyester resin (Tg, 59° C.; softening point Tm, 112° C.), 100 parts
A magnetic particulate iron oxide, 75 parts
Fischer-Tropsch wax (Sasol C105; melting point, 105° C.), 2 parts
A charge-controlling agent (T-77, Hodogaya Chemical), 2 parts After premixing with a Henschel mixer, these materials were melted and kneaded using a twin-screw extruder (trade name, PCM-30; Ikegai Ironwork) with a temperature setting such that the temperature of the melted material at the orifice should be 150° C.

The kneaded substance was cooled and roughly ground using a hammer mill. The resulting crude powder was pulverized using a grinder (trade name, Turbo Mill T250; Turbo Kogyo). The obtained fine powder was classified using a multifraction classifier based on the Coandă effect, and Toner particle 1 was obtained with a weight-average particle diameter (D4) of 7.2 μm. The softening point Tm of Toner particle 1 was 120° C.

Production Example of Toner 1

A wet process was used to add the organic-inorganic composite fine particle to Toner particle 1. One hundred parts by mass of the toner particle was dispersed in 2000 parts by mass of water containing "Contaminon N" (trade name; Wako Pure Chemical Industries). Three parts by mass of the liquid dispersion of Organic-inorganic composite fine particle 1 (solid concentration: 30%) was added while the toner particle dispersion was stirred. Then at a fixed temperature of 50° C., the dispersion was stirred for 2 hours so that Organic-inorganic composite fine particle 1 should be added to the surface of Toner particle 1. Filtering the resulting dispersion and drying the residue yielded a toner containing Organic-inorganic composite fine particle 1 added to the surface of Toner particle 1. Fumed silica (BET: 200 $m^2/g$) was mixed into this toner using a Henschel mixer in an amount such that the toner would contain 1.5 parts by mass of fumed silica and 100 parts by mass of Toner particle 1. Sieving the obtained mixture through a mesh having 150-μm pores yielded Toner 1. The number-average particle diameter of Organic-inorganic composite fine particle 1 determined through an SEM observation on the surface of Toner 1 was 135 nm.

Production Example of Toner 2

Toner 2 was obtained in the same way as in the production example of Toner 1 except that Organic-inorganic composite fine particle 1 was replaced with Organic-inorganic composite fine particle 2. The number-average particle diameter of Organic-inorganic composite fine particle 2 determined through an SEM observation on the surface of Toner 2 was 122 nm.

Production Example of Comparative Toner 1

Comparative toner 1 was obtained in the same way as in the production example of Toner 1 except that Organic-inorganic composite fine particle 1 was replaced with Organic-inorganic composite fine particle 3. The number-average particle diameter of Organic-inorganic composite fine particle 3 determined through an SEM observation on the surface of Comparative toner 2 was 129 nm.

Production Example of Comparative Toner 2

Comparative toner 2 was obtained in the same way as in the production example of Toner 1 except that Organic-inorganic composite fine particle 1 was replaced with Resin fine particle 1. The number-average particle diameter of Resin fine particle 1 determined through an SEM observation on the surface of Comparative toner 2 was 140 nm.

Production Example of Comparative Toner 3

One hundred parts by mass of Toner particle 1 was mixed with 0.9 parts by mass of colloidal silica (particle diameter: 120 nm) and 1.5 parts by mass of fumed silica (BET: 200 $m^2/g$) using a Henschel mixer. Sieving the obtained mixture through a mesh having 150-μm pores yielded Comparative toner 3. The number-average particle diameter of colloidal silica determined through an SEM observation on the surface of Comparative Toner 3 was 120 nm.

Table 2 summarizes the external additives used in Toners 1 and 2 and Comparative toners 1 to 3 and the amount of these additives per 100 parts by mass of the toner particle.

TABLE 2

| Toner | Toner particle | Amount of the external additives (per 100 parts by mass of the toner particle) | | | |
|---|---|---|---|---|---|
| Toner 1 | Toner particle 1 | Organic-inorganic composite fine particle 1 | 0.9 | Fumed silica | 1.5 |
| Toner 2 | Toner particle 1 | Organic-inorganic composite fine particle 2 | 0.9 | Fumed silica | 1.5 |
| Comparative toner 1 | Toner particle 1 | Organic-inorganic composite fine particle 3 | 0.9 | Fumed silica | 1.5 |
| Comparative toner 2 | Toner particle 1 | Resin fine particle 1 | 0.9 | Fumed silica | 1.5 |
| Comparative toner 3 | Toner particle 1 | Colloidal silica | 0.9 | Fumed silica | 1.5 |

Example 1

The evaluations in this example were conducted using HP LaserJet Enterprise 600 M603dn (Hewlett-Packard; processing speed, 350 mm/s), a commercially available printer using a magnetic one-component developer. Toner 1 was subjected to the following evaluations using this test machine. Evaluation results are provided in Table 3.

Evaluation of Development Performance

The toner was loaded into a specified process cartridge. A pattern of horizontal lines corresponding to a percent print coverage of 2% was printed on a total of 5000 sheets with the printer programmed so that it should halt between a job and the next job, with one job defined as printing of the pattern on two sheets. The image density was measured on the 10th and 5000th sheets. Evaluations were made under normal temperature and normal humidity conditions (temperature, 25.0° C.; relative humidity, 60%) and high temperature and high humidity conditions (temperature, 32.5° C.; relative humidity, 85%), which is easy to occur the contamination of the developer bearing member. The image density was measured as a reflection density of a 5-mm solid circle using a Macbeth density meter (Macbeth), which is a reflection densitometer, in combination with an SPI filter. The greater the value is, the better the result is.

Evaluation of the Contamination of the Developer Bearing Member

After image printing on a total of 5000 sheets for the evaluation of development performance under high temperature and high humidity conditions (temperature, 32.5° C.; relative humidity, 85%), the developer bearing member was removed, cleaned up of adhering toner using an air blower, and visually inspected for any sign of contamination.

Evaluation of Low-Temperature Fixation

A fixation apparatus was modified so that any desired fixation temperature could be chosen.

With this apparatus, a half-tone image is printed on bond paper (75 g/m$^2$) in such a manner that the image density should be in the range of 0.6 to 0.65 while the temperature of the fixing device is changed in steps of 5° C. within the range of 180° C. to 220° C. The obtained image was subjected to 5 cycles of to-and-fro rubbing with silbon paper under a load of 4.9 kPa, and the lowest temperature at which the percent decrease in image density due to rubbing was 10% or less was used as a measure of low-temperature fixation. The lower this temperature is, the better the low-temperature fixation is.

Evaluation of Storage Stability

Ten grams of the toner in a 100-mL plastic cup was left at 50° C. for 3 days. The storage stability of the toner was evaluated through measuring the degree of aggregation of the stored toner. The smaller the value is, the more fluidic the toner is.

In Example 1, the results of all evaluations were good.

Example 2 and Comparative Examples 1 to 3

The evaluations conducted in Example 1 were performed using Toner 2 and Comparative toners 1 to 3. Evaluation results are provided in Table 3.

TABLE 3

| | | Normal temperature and humidity (25.0° C., 60% RH) Image density | | High temperature and humidity (32.5° C., 85% RH) Image density | | Developer bearing member | Low-temperature | Degree of aggregation (%) | |
|---|---|---|---|---|---|---|---|---|---|
| | Toner | 10th sheet | 5000th sheet | 10th sheet | 5000th sheet | contamination 5000th sheet | fixation (° C.) | Before storage | After storage |
| Example 1 | Toner 1 | 1.42 | 1.40 | 1.40 | 1.38 | None | 180 | 11 | 20 |
| Example 2 | Toner 2 | 1.42 | 1.40 | 1.41 | 1.37 | None | 185 | 9 | 18 |
| Comparative Example 1 | Comparative toner 1 | 1.40 | 1.39 | 1.40 | 1.38 | None | 200 | 10 | 20 |
| Comparative Example 2 | Comparative toner 2 | 1.39 | 1.37 | 1.32 | 1.11 | Contaminated | 180 | 13 | 54 |
| Comparative Example 3 | Comparative toner 3 | 1.41 | 1.38 | 1.40 | 1.35 | None | 215 | 8 | 17 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-159300, filed Jul. 31, 2013, which is hereby incorporated by reference herein in its entirety.

The invention claimed is:

1. A toner comprising a toner particle and an external additive, wherein:

the external additive is an organic-inorganic composite fine particle, the organic-inorganic composite fine particle comprises a resin fine particle, and an inorganic fine particle which is embedded in the resin fine particle, and at least a part of which is exposed;

wherein an amount of the inorganic fine particle embedded in the resin fine particle is 10% by mass or more and 80% by mass or less based on a mass of the organic-inorganic composite fine particle; and the resin fine particle comprises a crystalline polyester having a melting point from 60° C. to 150° C.

2. The toner according to claim 1, wherein the inorganic fine particle includes at least one selected from the group consisting of silica fine particle, alumina fine particle, titania fine particle, zinc oxide fine particle, strontium titanate fine particle, cerium oxide fine particle, and calcium carbonate fine particle.

3. The toner according to claim 1, wherein the inorganic fine particle is silica fine particle.

4. The toner according to claim 1, wherein the organic-inorganic composite fine particle has a number-average particle diameter of 30 nm or more and 500 nm or less.

5. The toner according to claim 1, wherein the inorganic fine particle has a number-average particle diameter of 5 nm or more and 100 nm or less.

6. The toner according to claim 1, wherein the organic-inorganic composite fine particle is obtained by phase-inversion emulsification in the presence of the inorganic fine particle.

* * * * *